US011383893B2

(12) United States Patent
Foley

(10) Patent No.: US 11,383,893 B2
(45) Date of Patent: Jul. 12, 2022

(54) CONTAINER WITH CAP OPENING FEATURE

(71) Applicant: Brian Edward Foley, Murrieta, CA (US)

(72) Inventor: Brian Edward Foley, Murrieta, CA (US)

( * ) Notice: Subject to any disclaimer, the term of this patent is extended or adjusted under 35 U.S.C. 154(b) by 0 days.

(21) Appl. No.: 15/868,792

(22) Filed: Jan. 11, 2018

(65) Prior Publication Data

US 2018/0194522 A1 Jul. 12, 2018

Related U.S. Application Data

(60) Provisional application No. 62/445,083, filed on Jan. 11, 2017.

(51) Int. Cl.
*B65D 41/04* (2006.01)
*B67B 7/14* (2006.01)

(52) U.S. Cl.
CPC .. *B65D 41/0485* (2013.01); *B65D 2251/1075* (2013.01); *B67B 7/14* (2013.01)

(58) Field of Classification Search
CPC .. B65D 50/067; B65D 41/0485; A63H 33/08; A63H 33/082; A63H 33/084; A63H 33/086; A63H 33/088
USPC ..... 215/302, 215, 303; 220/284
See application file for complete search history.

(56) References Cited

U.S. PATENT DOCUMENTS 895,261 A * 8/1908 Hapgood ..... B65D 41/0485 215/302
1,351,304 A * 8/1920 Shelton ..... B67B 7/18 215/302
1,932,147 A * 10/1933 Sabatine ..... B67B 7/18 215/302
3,653,530 A * 4/1972 Winfrey ..... B65D 41/0485 215/302
4,775,061 A * 10/1988 Coote ..... B65D 50/068 215/215
5,361,919 A * 11/1994 Hull ..... B65D 81/361 215/228
7,371,146 B2 * 5/2008 Scarborough ..... A63H 33/062 446/108

(Continued)

FOREIGN PATENT DOCUMENTS

GB 191016893 A * 11/1910 ..... B65D 41/0485
JP 2003226343 A * 8/2003 ..... B65D 41/0485

*Primary Examiner* — Allan D Stevens
(74) *Attorney, Agent, or Firm* — Snell & Wilmer L.L.P.

(57) ABSTRACT

Containers comprise a container body and a cap, wherein the cap comprises a surface feature configured to accommodate engagement with a member to provide desired increased leverage to a user to aid loosening and/or removing the cap from the container. The surface feature may be an opening or any other surface feature, and the member may be another container having a cap or container body having a surface feature configured to complement and fit the surface feature of the cap, forming an interlocking attachment therewith. Both containers may be configured identically, each having surface features that complement one another, thereby forming a system made up of such two containers for loosening/removing the caps of one another. The caps each may include an opening and a section sized to fit in the opening so that the section of one cap fits in the opening of the other cap.

11 Claims, 4 Drawing Sheets

(56) References Cited

U.S. PATENT DOCUMENTS

| | | | | |
|---|---|---|---|---|
| 2006/0151417 | A1* | 7/2006 | Fuchs | B65D 35/44 215/256 |
| 2006/0261063 | A1* | 11/2006 | Dyehouse | B65D 21/0204 220/23.4 |
| 2007/0045219 | A1* | 3/2007 | Nasiatka | B65D 1/02 215/302 |
| 2012/0037630 | A1* | 2/2012 | Nasiatka | B65D 41/0485 220/284 |
| 2017/0183130 | A1* | 6/2017 | Jeong | B65D 41/0485 |
| 2017/0259964 | A1* | 9/2017 | Suh | B65D 41/0485 |
| 2019/0127129 | A1* | 5/2019 | Van Den Hoonaard | B65D 47/122 |

* cited by examiner

CONTAINER WITH CAP OPENING FEATURE

CROSS-REFERENCE TO RELATED APPLICATIONS

This patent application claims the benefit of U.S. Provisional Patent Application No. 62/445,083, dated Jan. 11, 2017, which is hereby incorporated by reference in its entirety.

FIELD

Containers as disclosed herein include a lid or cap, wherein the container is configured having one or more features specifically engineered to assist with the loosening and/or removal of such lip or cap of from the container and, more specifically, wherein the container lip or cap includes such one or more features to facilitate the removal of the same from the container by hand.

BACKGROUND

The use of bottles, cans and other types of products configured to contain a volume of liquid or gas is well known in the art, and are generally referred hereto as "containers". Such containers generally include an opening for accessing the liquid or gas disposed within the container, which opening may be sealed until desired use/removal through the use of a cap, lid or other element that is generally configured to cover the opening to prohibit an undesired removal of the container contents, e.g., during shipping or storage or otherwise before use of the contents of the container is desired.

Such caps or lids may be configured having a portion that registers with a portion of the respective container positioned at or adjacent the opening. A few examples of well-known containers include those having a cap or lid that is configured to provide a releasable attachment with the container through the use of complementary threaded interaction, or to provide a releasable attachment through an interference squeeze fit, whereby the cap or lid is removed by the respective turning and threaded disengagement of the cap and container, or the urging of the cap or lid over an expanded end of the container opening.

With respect to containers that are configured having a threaded cap or lid attachment, it is well known that the removal of such cap or lid from the container by hand may be difficult, e.g., in instances where the cap is overtightened to the lid, and/or where the cap is sized in a manner making grasping of the cap in one's hand difficult for the purpose of twisting the same for loosening and removal, and/or when a liquid in the container is disposed along a portion of the threaded interaction and possibly dried. In each of these example instances, removal of a cap or lid that is threadably connected or engaged with the container may make the task of loosening and removing the cap too difficult to be performed by hand.

According, there exists a need to develop a container having features specifically configured to enable a user to open the lid or cap of such container by hand in a manner that overcomes the impediments noted above existing with known containers and caps.

SUMMARY

Containers as disclosed herein generally comprise a container body and a cap. The container body is capable of accommodating a desired volume of material, e.g., fluid, gas, powder or the like, and has an opening through which the material can be removed. A cap is removably attached to the container body open for purposes of sealing the material inside from inadvertently escaping. In an example embodiment, the container cap is configured to be threadably engaged with the container body so that the cap can be loosened and/or removed by a user twisting the cap relative to the body to threadably decouple the cap from the bod. In an example, the cap comprises a surface feature that is configured to be engaged by a member for providing additional leverage to the user to the cap for removal and/or loosening.

In an example, the surface feature can be any feature that is configured to cooperate and provide an interlocking connection with the member. In an example, the cap surface feature may be provided in the form of an opening positioned diametrically relative to the cap and that may extend completely or partially through the cap to accommodate placement of the member therein. Alternatively, the surface feature may be provided in the form of a projecting element or recessed element on the cap and the member may comprise a surface feature that complements and interlocks with the cap surface feature to provide the addition leverage useful for cap loosening and/or removal. In an example, the member may be another container and the surface feature that cooperates with the surface feature of the cap may be located on the cap or container body of the other container.

In an example embodiment, where the cap surface feature comprises an opening, the other container includes a cap that has a section, e.g., a reduced diameter section, that is sized to fit within the opening to provide the desired increased leverage. In another example embodiment, where the cap surface feature is a projecting element or a recess, the other container may comprise a cap or a container body having a surface that includes a complementary surface feature configured to cooperate with and interlock with the surface feature of the cap to provide the desired increased loosening and/or removal leverage. If the other container comprises the surface feature on the cap, it may be positioned along a top surface of the cap. If the other container comprises the surface feature on the container body, it may be positioned along a bottom surface of the container body.

In an example embodiment, a system for aiding loosening of a cap threadably attached to a container body of a container from the container body comprises a pair of containers each comprising a container body and a container cap, wherein one of the container caps comprises a surface feature that is configured to register with one of a surface feature of the other container cap a surface feature of the other container body, and wherein upon registration of the surface features additional leverage is provided to a user to facilitate hand removal of a container cap from container body by twisting or turning movement as between the paid of containers.

Depending on how the container cap surface feature and the member or surface feature of another container are configured, the container and member may be oriented perpendicular relative to one another or coaxial relative to one another to provide the desired additional leverage to a user to loosen and/or remove the cap by hand.

A method for loosening or removing a cap from a container as disclosed herein, wherein the container comprises a body and a cap attached thereto and comprising a volume of liquid or gas to be removed therefrom, comprises aligning a surface feature of the container cap with a another member, wherein such other member may be another container. Once the surface feature of the container cap and member are aligned with one another, they are engaged to thereby form an interlocking attachment therebetween. Once such attachment is achieved, the user may loosen and/or remove the cap by rotating one of the member or the container body relative to the other. As noted above, the member may be provided in the form of another container comprising a surface feature positioned on the other container cap or other container body that is configured to register and form an interlocking connection with the cap for providing a relatively easier leveraged loosening and/or removal of the cap by hand.

BRIEF DESCRIPTION OF THE DRAWINGS

These and other features and advantages of containers as disclosed herein will be appreciated as the same becomes better understood by reference to the following detailed description when considered in connection with the accompanying drawings wherein.

DETAILED DESCRIPTION

Containers as disclosed herein are specially engineered to include surface features present in one or both of the container body and container cap that are complement one another such that engagement of a surface feature of one container with the complementary surface feature of another container operates to enable a user to easily loosen and/or remove the cap of the container by hand, thereby overcoming the impediments noted above as associated with threaded engagements between the cap and container becoming too tight to permit loosening of the cap by hand. In an example, the containers may be constructed having caps configured with surface features complementary to one another so that the surface feature of one cap engages the surface feature of the other cap to facilitate removal of one of the caps. In another embodiment, the containers may be construction having a cap configured having a surface feature that is complementary to a surface figure of another container such that engagement of the cap surface feature of one container with the surface feature of another container enables a user to easily remove the cap by rotation of one of the container relative to the other. Further details and features of containers as disclosed herein are presented below with reference to certain figures.

It is to be understood that while containers as disclosed and illustrated herein are presented in the context of certain container embodiments, containers comprising the features as disclosed herein for purposes of enabling loosening and removal of caps from containers are intended to apply to all containers however shaped or embodied, such as bottles, tubes, jars and the like and containing any type of material such as fluids, powders, gases and the like for any purpose, such that the features disclosed herein are understood to not be limited to any particular container type.

Figure 1:
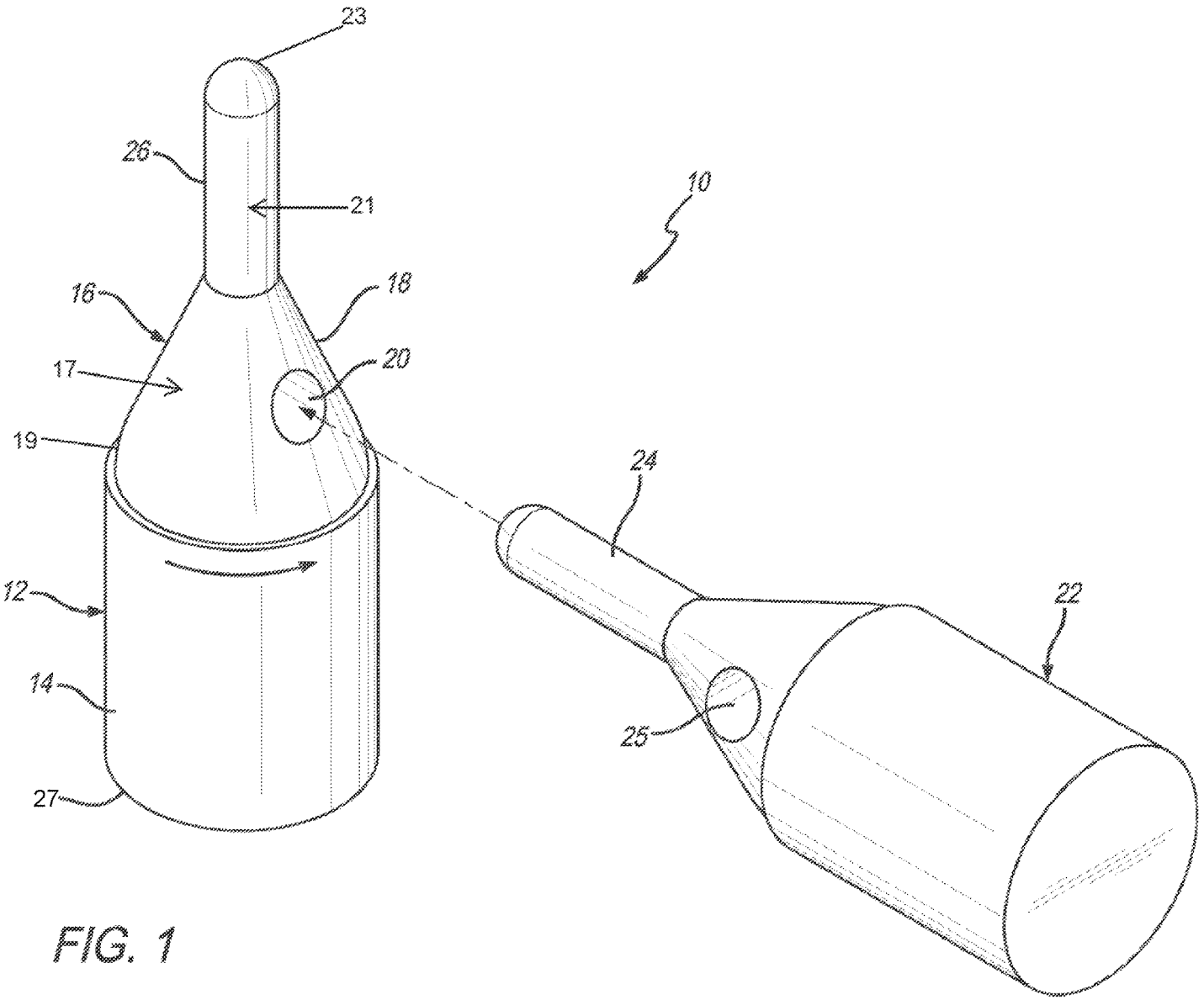
FIG. 1 is a perspective view of an embodiment of containers as disclosed herein comprising caps configured to facilitate cap loosening/removal.

FIG. 1 illustrates an example embodiment of a pair of containers 10 as disclosed herein configured to facilitate loosening and/or removal of a cap by hand. In this embodiment, a first container 12 comprises a body 14 and a cap 16, wherein the body may be made from any suitable material for containing a volume of liquid, such as glass, plastic, metal and the like. The body has a generally cylindrical shape with a closed end forming a bottom 27 and an open end (not shown) opposite the closed end and comprising reduced diameter neck (relative to the body) extending axially outwardly away from the body and having an outside surface that is threaded to facilitate threaded engagement with the cap 16.

The cap 16 may be formed from any suitable material, such as plastic, glass, wood, metal and the like capable of forming a threaded attachment with the container. Thus, the cap includes an axially extending internal cavity that is threaded in a manner that complements the threaded outside surface of the container opening. The cap includes a first section 17 that extends axially away from a first axial terminal end 19 positioned adjacent the body open end, wherein the first section 17 extends to a second section 21 that extends to a second axial terminal end 23 of the cap 16. The first section 17 may have an outside surface 18 that is cylindrical in shape as illustrated, or alternatively may be square, rectangular or of any other shape. In an example, the first section 17 may have a conical shape that decreases in diameter moving axially away from the first axial end, and the second section 21 may have a reduced diameter relative to the first section. In an example, the second section 21 may be cylindrical and have a constant diameter extending from the first section 17 to the second axial end 23. The cap outside surface 18 may or may not complement that of the container body. A feature of the cap 16 in this embodiment is that it includes a surface feature in the form of an opening 20 passing diametrically through the cap. In such an embodiment, it is desired that the cap be configured having a sufficient radial thickness to permit the placement of the opening therethrough without otherwise weakening the structure of the cap.

In the example illustrated, the cap opening 20 is sized to accommodate placement of an identically configured second container 22 cap surface feature 24 therein. In such example embodiment, the caps of both the first and second container 12 and 22 are configured identically, and each respective cap comprises an opening 20 and 25, and a reduced diameter section 26 and 24 that is configured to fit within the respective openings 25 and 20. In such example, for each cap, the reduced diameter section is positioned adjacent the opening and extends a distance therefrom forming the distal end of the cap. This is but one example embodiment of how caps of containers may be configured identically to include surface features that cooperate/engage with one another to permit a user to combine the containers in a manner where one container cap engages the other container cap for purposes of facilitating loosening and/or removal of the container cap by hand quickly and easily. While the openings 20 and 25 have been shown having a circular configuration, it is to be understood that the opening can have any other type of configuration capable of cooperating with the reduced diameter section.

In an example use, the reduced diameter section of one container cap is placed within the opening of the other container cap to place the relative containers perpendicular to one another. This is beneficial for purpose of creating a horizontal leverage point (via the container positioned in a horizontal position with its reduced diameter section disposed in the opening of the container in a vertical position) useful for more easily loosening and/or removing the cap of the container (in the vertical position). It is to be understood, that the containers do not have to be positioned horizontally or vertically to benefit from the improved leverage gained by a user from the relative perpendicular orientation of the containers once the surface features are engaged.

In an example end use, both containers may be nail polish containers where a user would have a number of such containers that contain a different color or type of nail polish, so it would be easy to have two or more such containers readily available to the user for purposes of combining in the manner noted to facilitate cap removal. In such example use, it is well known that nail polish on the threaded portion of the container or cap may operate to otherwise make removal difficult by hand. It is understood that there may be many more such container cap embodiments that may accomplish the intended function, all of which container cap embodiments are intended to be within the scope of this disclosure.

Figure 2:
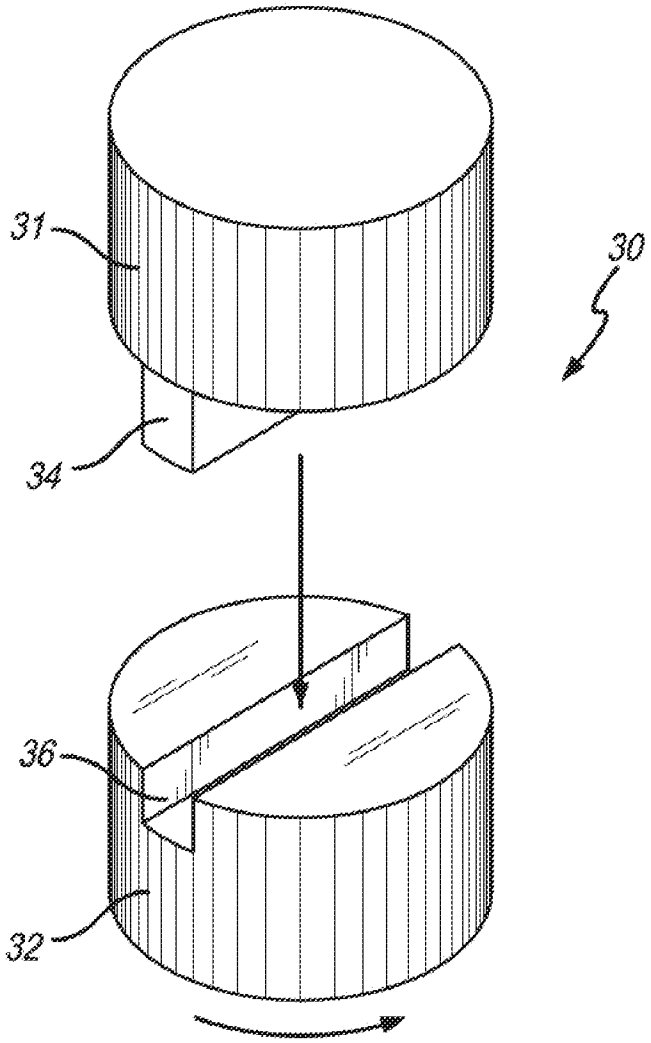
FIG. 2 is a perspective view of another embodiment of containers as disclosed herein comprising caps configured to facilitate cap loosening/removal.

FIG. 2 illustrates FIG. 1 illustrates an example embodiment of a pair of containers 30 comprising container caps 31 and 32 as disclosed herein configured to facilitate loosening and/or removal of a cap by hand. In this embodiment, one or both of the container caps are connected to a respective container. In this embodiment, the container cap 31 comprises a surface feature 34 that is configured to cooperate with surface feature 36 of the container cap 32. The surface feature 34 is configured in the form of a projecting element that is sized and shaped to fit within the surface feature 36 provided in the form of a recess. In this embodiment, the projecting element 34 is provided in the form of a blade extending outwardly from the surface of the cap 31, and the recess 36 is provided in the form of a slot disposed a depth below a top surface of the cap 32 and configured to accommodate the blade therein. Configured in this manner, a user can loosen and/or remove the cap 32 that is connected with a container (not shown) by using the cap 31 (attached or not attached to a respective container) and twisting one cap/container relative to the other. While this is but one example embodiment illustrating caps configured having differently-shaped surface features designed to cooperate with one another to permit interlocking engagement for facilitate loosening and/or removal of one cap relative to the other, it is understood that many other such complementary differently-shaped surface features that function to provide the desired interlocking engagement are possible and that such is thereby understood and intended to be within the scope of the containers as disclosed herein.

Figure 3:
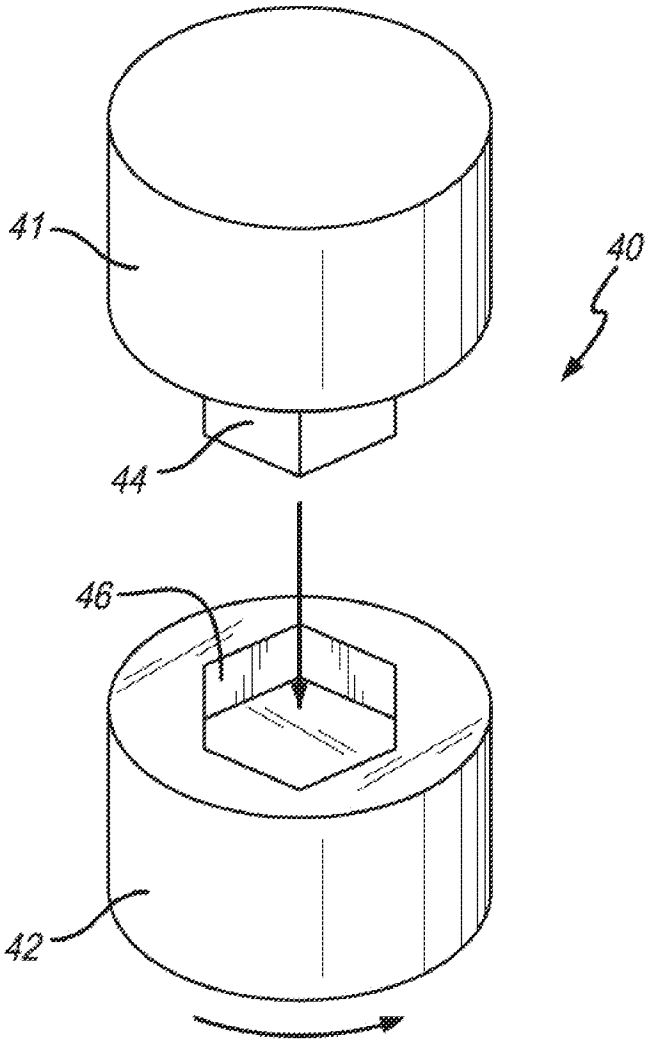
FIG. 3 is a perspective view of another embodiment of containers as disclosed herein comprising caps configured to facilitate cap loosening/removal.

FIG. 3 illustrates an example embodiment of a pair of container 40 comprising caps 41 and 42 as disclosed herein configured to facilitate loosening and/or removal of a cap by hand. In this embodiment, one or both of the container caps are connected to a respective container. In this embodiment, the container cap 41 comprises a surface feature 44 that is configured to cooperate with surface feature 46 of the container cap 42. In an example, the surface feature 44 is configured in the form of a projecting element or the like that is sized and shaped to fit within the surface feature 46 provided in the form of a recess. In this embodiment, the projecting element 44 is provided in the form of a hexagonal head extending outwardly from the surface of the cap 41, and the recess 46 is provided in the form of a hexagonal opening disposed a depth below a top surface of the cap 42 and configured to accommodate the hexagonal head therein. Configured in this manner, a user can loosen and/or remove the cap 42 that is connected with a container (not shown) by using the cap 41 (attached or not attached to a respective container) and twisting one cap relative to the other. While this is but one example embodiment illustrating caps configured having differently-shaped surface features designed to cooperate with one another to permit engagement for facilitate loosening and/or removal of one cap relative to the other, it is understood that many other such complementary differently-shaped surface features are possible and that such is understood and intended to be within the scope of the containers as disclosed herein.

Further, while the surface features 44 and 46 have each been described as being part of the cap, in an alternative embodiment one of the surface features can be provided as part of the container body, e.g., disposed at the container bottom or the like, so that the desired cap loosening and/or removal may occur by engaging the bottom of one container body with the cap of another container. In such embodiment, it is useful if the surface feature of the container body, if disposed along the body bottom surface, is one configured in a manner that enables the placement/storage of the container on a planar surface. In the embodiments illustrated in FIGS. 2 and 3 during the process of engaging the surface features the containers are positioned relative to one another in a common axial alignment.

Figure 4:
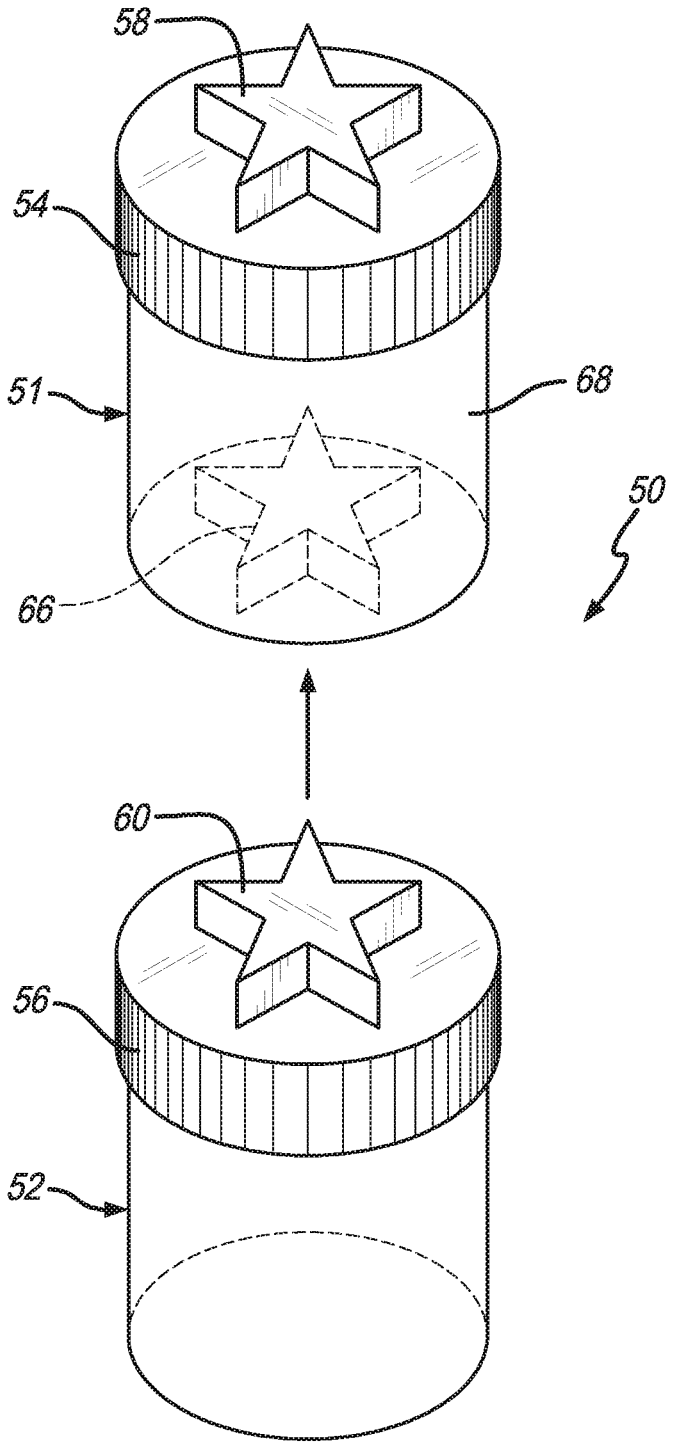
FIG. 4 is a perspective view of another embodiment of containers as disclosed herein comprising complementary features in the cap and container configured to facilitate cap loosening/removal.

FIG. 4 illustrates an example embodiment of containers 50 comprising of pair of containers 51 and 52 as disclosed herein configured to facilitate loosening and/or removal of a container cap by hand. In this embodiment, one or both of the container caps are connected to a respective container. In this embodiment, each of the containers 51 and 52 may be configured comprising caps 54 and 56 that are each configured having the same type of surface feature 58 and 60. In an example, the surface 58 and 60 features are disposed along a top surface of the caps. In example, the surface feature 60 is configured to project outwardly a distance from the cap 56 top surface and is shaped to cooperate with a surface feature 66 of a body 68 of the container 51. In the illustrated example, the cap surface feature is provided in the form of a star-shaped projection, and the container body surface feature is provided in the form of a complementary star-shaped recess to accommodate the star projection therein. It is to be understood that the surface features of the cap and container body may be other than as illustrated and described for purposes of providing a complementary interlocking engagement and fit therebetween, and that all other such configurations of surface features capable of providing an interlocking engagement for the desired purpose are intended to be within the scope of the containers as described herein.

Configured in this manner, a user can loosen and/or remove the cap 56 that is connected with the container 52 by engaging the surface feature 60 of the cap 56 with the surface feature 66 of the container body 68, and once engaged the user may loosen and/or remove the cap 56 by relative rotation of the containers 51 and 52. As noted above, while this is but one example embodiment illustrating caps configured with surface features designed to cooperate with surface features of container bodies, it is to be understood that any and all configurations of surface features between caps and bodies that provide such cooperative engagement for the purpose of enabling loosening and/or removal of a cap by use of another container are understood to be within the scope of containers as disclosed herein. For example, while the surface feature of the container body has been illustrated as being positioned along a bottom portion of the container, it is to be understood that the surface feature that registers with a surface feature of a cap may be located at a position on the container body other than on the bottom surface, such as along a sidewall surface of the like.

Figure 5:
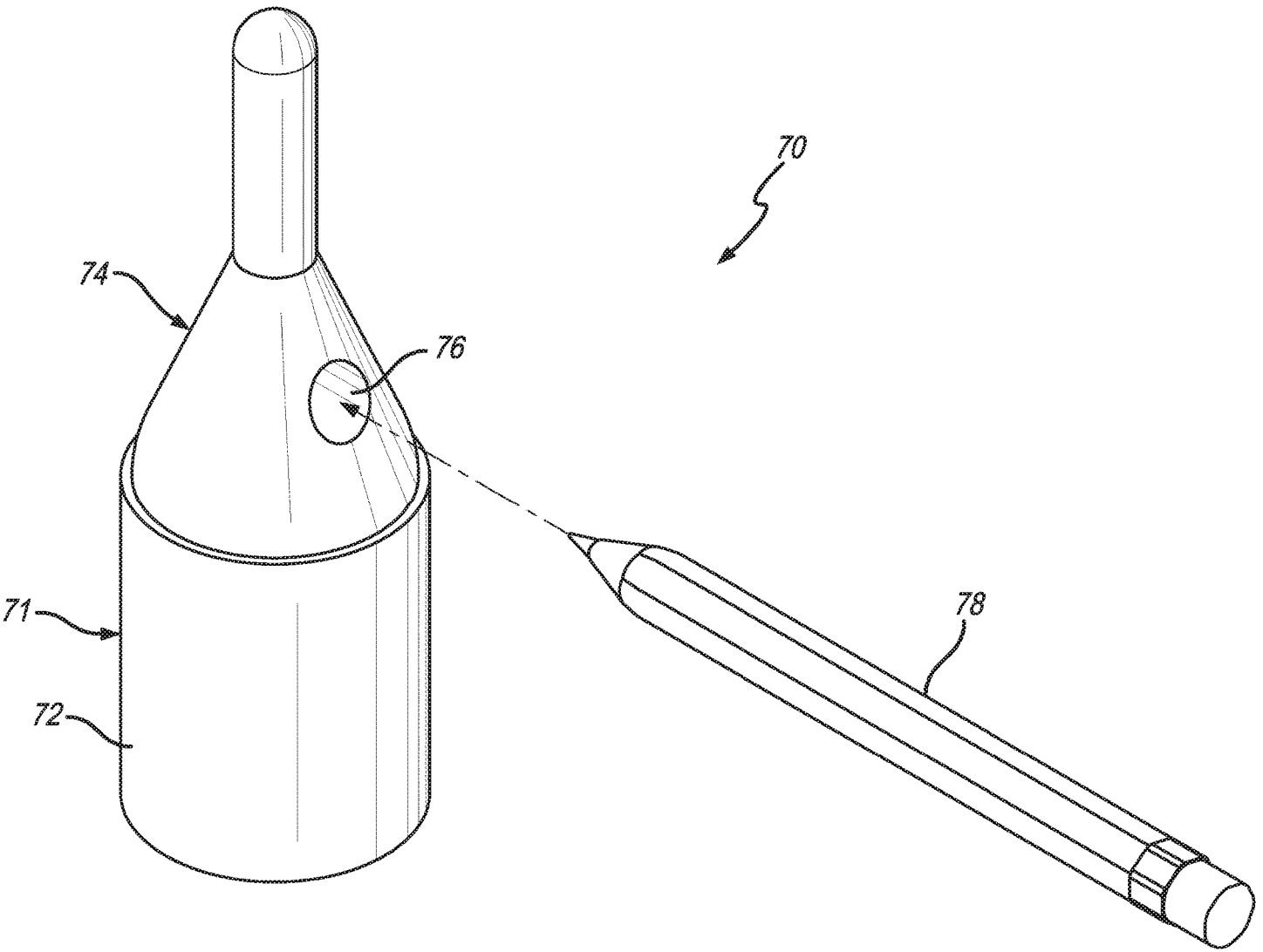
FIG. 5 is a perspective view of the embodiment of container illustrated in FIG. 1 illustrating the use of an object independent of another container to engage the cap to facilitate cap loosening/removal.

FIG. 5 illustrates and embodiment of system 70 for removing a container cap comprising a container 71 as disclosed herein that is similar to the container illustrated in FIG. 1, wherein the container comprises a container body 72 and a cap 74 attached to an open end of the container body. As illustrated, the cap is configured having a surface feature in the form of an opening 76 extending diametrically partially or completely through a portion of the cap. As mentioned above for the embodiment illustrated in FIG. 1, such opening may operate to accommodate placement of a cap reduced diameter section of another identically-configured container for the purpose of providing additional leverage to thereby facilitate loosening and/or removing the cap 74 from the body, i.e., by rotating one of the cap 74 or body 72 relative to the other of the cap or body. In the embodiment illustrated in FIG. 3, a member 78 (other than a portion of another container) that is capable of fitting into the cap opening 76 is used for the purpose of being placed into the cap opening for providing added leverage to a user for purposes of facilitating loosening and/or removing the cap from the container body by hand. In an example, the member 78 may be in the form of a readily-available object such as a pencil or pen or the like. However, it is to be understood that any other members capable of fitting into the cap opening for the intended purpose of providing additional leverage for purposes of rotatably loosening and/or removing the cap from the container body are intended to the within the scope of this concept and disclosure.

A feature of the containers as disclosed herein is that they are construction in a manner that enables a user to loosen and/or remove a cap from engaging/releasibly interlocking two caps and/or containers together for the purpose of providing added leverage to a user to enable the user to open an otherwise difficult-to-open cap by hand. The surface features provided in the caps and/or containers may be provided by conventional means depending on the type of construction material, e.g., the surface features may be provided by molding, stamping, printing, machining or other methods known in the art.

Containers as disclosed herein may be used for the purpose of easing the leverage removal of a cap from a container body by a user in the following manner. The user engages the member with the surface feature of the cap container so that the member forms an interlocking engagement with the cap. In an example, the member may be another container as described above comprising a complementary surface feature that fits with the cap surface feature, and wherein the complementary surface feature may be part of the other container cap or other container body depending on the particular embodiment. The user may then loosen and remove the cap by grasping the member or other container engaged with the cap and rotating one of the container or member relative to the other, wherein the member or other container provide a desired degree of increased leverage to the user to more easily loosen and/or remove the container cap by hand.

Other modifications and variations of containers as disclosed herein will be apparent to those skilled in the art. It is, therefore, to be understood that within the scope of the appended claims, the containers as disclosed herein may be practiced otherwise than as specifically described. While containers have been described an illustrated having example configurations, it is to be understood that containers as disclosed herein may take on any configuration useful for accommodating a volume of material, such as bottles, tubes, cans and the like. It is also understood that the contents of such containers are not limited for a particular end use and may include any and all types of materials including and not limited to liquids, powders, gases and the like for all types of end uses applications that are not herein limited. Examples of such uses may include and are not limited to cosmetics, medicines, household materials, office supplies, paints, tooth pastes, sealants and the like.

What is claimed is:

1. A container having a surface feature for facilitating opening of the container, the container comprising:

a body configured to accommodate a volume of material therein, the body having a closed end and an open end, wherein the open end is provided for removal of the volume of material therefrom; and a cap removably attached with the body open end and comprising a first section having a conical outside surface, wherein the first section extends axially away from a cap first axial terminal end, wherein the cap first axial terminal end is adjacent the body open end when the cap is attached with the body, and a second section extending from the first section to an opposed cap second axial terminal end, wherein the container surface feature is disposed within the cap first section and is configured to accommodate engagement with a member for purposes of providing additional leverage to a user for removing the cap from the container body;

wherein the container surface feature is provided in the form of an opening in the cap, and wherein the cap second section is cylindrical in shape and has an outside diameter sized smaller than the cap opening.

2. The container as recited in claim 1 wherein the opening extends partially or completely through a diameter of the cap.

3. A container having a surface feature for facilitating opening of the container, the container comprising:

a body configured to accommodate a volume of material therein, the body having a closed end and an open end, wherein the open end is provided for removal of the volume of material therefrom; and a cap removably attached with the body open end and comprising a first section having a conical outside surface, wherein the first section extends axially away from a cap first axial terminal end, wherein the cap first axial terminal end is adjacent the body open end when the cap is attached with the body, and a second section extending from the first section to an opposed cap second axial terminal end, wherein the container surface feature is disposed within the cap first section and is configured to accommodate engagement with a member for purposes of providing additional leverage to a user for removing the cap from the container body;

wherein the container surface feature is provided in the form of an opening extending radially within the cap first section, wherein the container cap second section is cylindrical and sized having an outside diameter that is less than an inside diameter of the opening.

4. The container as recited in claim 3 wherein the removable container cap is configured to be engaged with an identical removable container cap of another container to facilitate removal of the container cap from the body by orienting the identical removable container cap at a 90 degree angle relative to the container cap and placing a second section of the identical removable container cap into the opening.

5. The container as recited in claim 3 wherein the cap first section has a constant decrease in diameter moving from the first axial terminal end to the second section.

6. A container comprising:

a body configured to accommodate a volume of material therein, the body comprising a closed end and an open end; and a cap that is configured to attach with the open end of the body by rotational movement of the cap relative to the body, the cap including a surface feature that is configured to be engaged by an object to facilitate rotational movement of the cap relative to the body when the cap is attached to the body for purposes of loosening the cap from the body, the cap comprising a cone-shaped first section that extends axially away from a first axial terminal end of the cap, wherein the cap first axial terminal end is adjacent the body open end when the cap is attached to the body, the cap comprising a second section that extends axially away from the first section to a second axial terminal end of the cap, wherein the surface feature comprises an opening that extends radially into the cap first section;

wherein the cap second section is cylindrical and has an outside diameter that is sized smaller than the opening.

7. The container as recited in claim 6 wherein the opening extends completely through the cap.

8. A container comprising:

a body for accommodating a volume of material therein and having an open end;

a cap configured for rotatable attachment with the body open end and comprising:

a first section that extends axially from a first axial end of the cap, wherein the first axial end of the cap is adjacent the body open end when the cap is attached therewith, the first section having an outside diameter that extends axially along the cap from the first axial end to a cap second section, wherein the cap second section has an outside surface configured differently than the first section; and an opening disposed radially in the cap first section that is configured to accommodate placement of an object therein;

wherein the cap second section is cylindrical and has an outside diameter different than that of the cap first section and that is smaller than an inside diameter of the opening.

9. The container as recited in claim 8 wherein the cap first section outside diameter changes moving axially along the cap first section.

10. The container as recited in claim 8 wherein the cap first section has a conical shape with a decreasing outside diameter moving axially away from the first axial end.

11. The container as recited in claim 8 wherein the cap second section outside diameter is less than that of the cap first section outside diameter.

* * * * *